United States Patent [19]

Fuchs, Jr.

[11] 3,948,079

[45] Apr. 6, 1976

[54] MULTIPLE APERTURE DIE

[75] Inventor: Francis Joseph Fuchs, Jr., Princeton Junction, N.J.

[73] Assignee: Western Electric Company, Inc., New York, N.Y.

[22] Filed: Oct. 2, 1975

[21] Appl. No.: 619,130

Related U.S. Application Data

[63] Continuation of Ser. No. 523,404, Nov. 13, 1974, abandoned.

[52] U.S. Cl. ..... 72/468; 72/261; 425/464

[51] Int. Cl.[2] ..... B21C 3/06

[58] Field of Search ..... 72/468, 261, 262, 268, 72/253, 368; 425/461, 464

[56] References Cited

UNITED STATES PATENTS

| | | | |
|---|---|---|---|
| 2,973,092 | 2/1961 | Graham | 72/256 |
| 3,740,985 | 6/1973 | Fuchs | 72/60 |

FOREIGN PATENTS OR APPLICATIONS

| | | | |
|---|---|---|---|
| 217,027 | 1/1958 | Australia | 72/468 |

*Primary Examiner*—Milton S. Mehr
*Attorney, Agent, or Firm*—D. P. Kelley; A. S. Rosen

[57] ABSTRACT

Billet material is extruded through a die having a plurality of die apertures thereby to produce simultaneously a plurality of extruded products such as wire. In one embodiment, the die has a conical mouth with a first die aperture at the apex thereof and with a plurality of radially equispaced second die apertures located forwardly of the first die aperture, the second die apertures having bevelled entries at the inlet ends thereof communicating with the conical mouth. In another embodiment, the die has multiple aperture groupings arranged therein, each grouping having a central die aperture and a plurality of peripheral die apertures radially equispaced about the central die aperture.

7 Claims, 6 Drawing Figures

FIG. 1
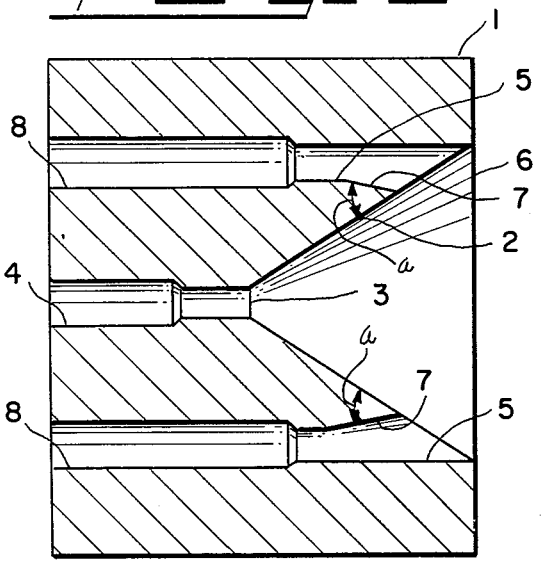
FIG. 2
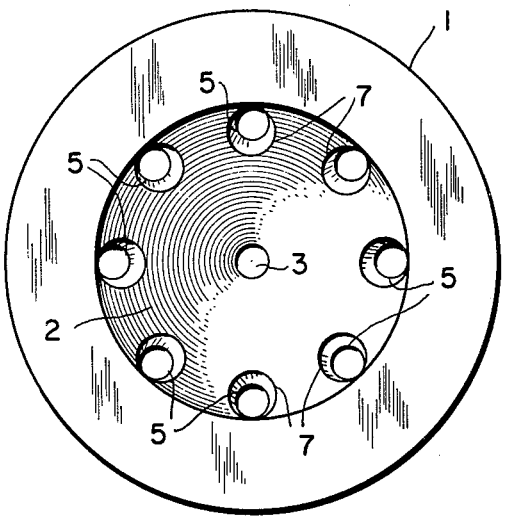
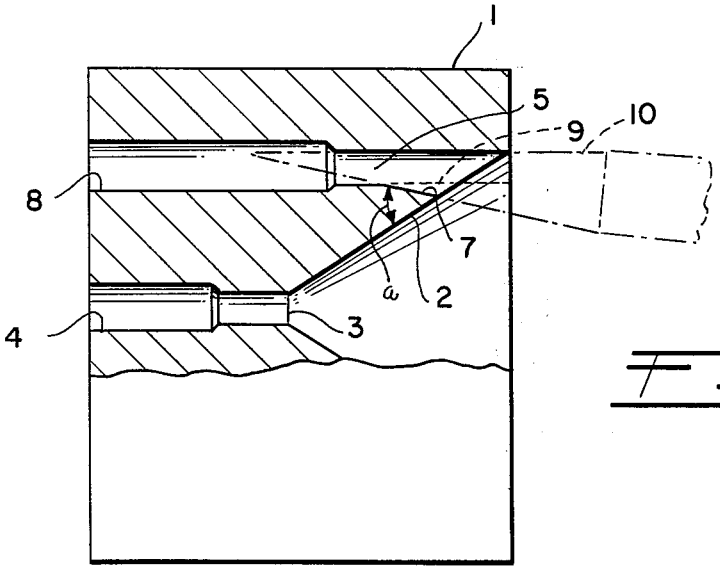
FIG. 3
FIG. 4
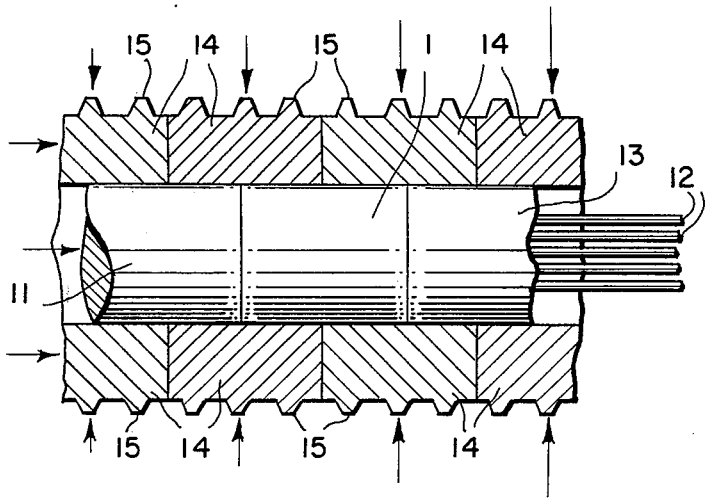

MULTIPLE APERTURE DIE

This is a continuation of application Ser. No. 523,404 filed Nov. 13, 1974, abandoned.

BACKGROUND OF THE INVENTION

1. Field of the Invention

This invention relates, broadly speaking, to apparatus for the multiple production of elongated product such as wire. More specifically, this invention relates to dies of particular design in which billet material, which may be of indefinite length, may be deformed to produce, simultaneously, a plurality of elongated products such as wire.

2. Description of the Prior Art

Simultaneous production of multiple wires from the deformation of billet material is known to those familiar with this art.

U.S. Pat. No., 3,394,579 (1968) to Hall et al. discloses method and apparatus for extruding a plurality of products simultaneously. In one embodiment, a single billet is extruded through a die having plural apertures. In another embodiment, a plurality of billets is simultaneously extruded through respective apertures in a die having plural apertures.

U.S. Pat. Nos. 2,050,298 (1936) and 2,077,682 (1937) both to Everett disclose assembling a plurality of discrete billets in a bundle, placing the bundle in a metallic sheath, packing the sheath around the bundle with a pulverulent or a plastic material which functions as a separating medium between the billets, drawing the sheath and the bundle enclosed thereby through a series of dies, seriatim, to reduce the sheath and the enclosed bundle, and thereafter removing the drawn sheath by chemical or electrolytic means or by stripping the drawn sheath from the wires formed by the drawn billets.

U.S. Pat. No., 3,540,114 (1970) to Roberts et al. discloses assembling a plurality of wires in a bundle, placing the bundle in a sheath, applying a thin film of lubricant to the bundle, drawing the sheath and bundle through a die to reduce the individual wires to fine filaments, and then unwrapping or chemically etching the drawn sheath to remove it from the filaments.

The subject matter of this application represents a further and subsequent development based on prior die designs actually reduced to practice and disclosed in a copending application by Glenn L. Schmehl filed concurrently herewith and entitled "Multiple Aperture Die."

SUMMARY OF THE INVENTION

An object of this invention is to provide an improved die for the simultaneous extrusion therethrough of a plurality of wires from billet material.

Other and further objects of this invention will become apparent during the course of the following description and by reference to the accompanying drawings and the appended claims.

Briefly, one of the embodiments of improved die which is the subject of this invention has a flared mouth with a first die aperture at the apex of the flared mouth and with a plurality of second die apertures radially equispaced around the perimeter of the mouth of the die.

In another embodiment of improved die, the die may have a plurality of multiple aperture groupings with converging entries to each multiple aperture grouping and to each die aperture in each of said multiple aperture groupings.

BRIEF DESCRIPTION OF THE DRAWINGS

Referring now to the drawings in which like numerals represent like parts in the several views:

FIG. 1 represents a medial longitudinal section through one embodiment of the improved die;

FIG. 2 represents a view in elevation of the entrance end of the improved die of FIG. 1;

FIG. 3 represents a partial medial longitudinal section through the improved die of FIG. 1, showing in phantom outline a rotary tool applied to a die aperture to form the mouth thereof;

FIG. 4 represents a medial longitudinal section through one form of extrusion apparatus incorporating an improved die, showing the plurality of elongated products produced simultaneously thereby;

DESCRIPTION OF THE PREFERRED EMBODIMENTS

Figure 5:
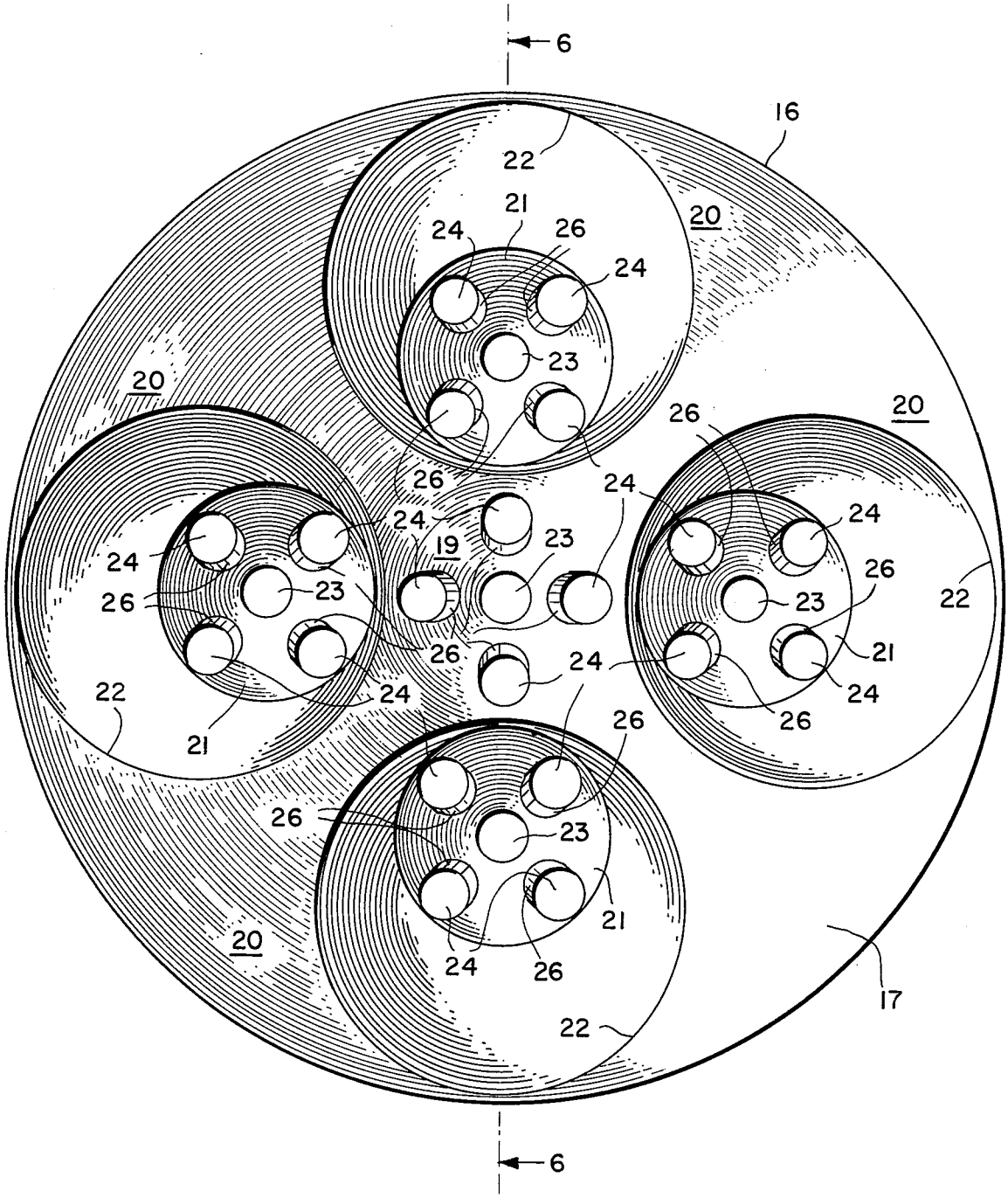
FIG. 5 represents a view in elevation of the entrance end of an alternate embodiment of improved die.

Referring now to FIGS. 1 and 2, die 1 is seen as comprising a conical mouth 2 at the apex of which is provided a first die aperture 3 extending through the said die 1 and communicating with passageway 4 at the rear end of the die 1. A plurality of second die apertures 5 is formed through the conical mouth 2 adjacent the entrance end 6 of the die 1, the said second die apertures 5 being radially equispaced around the die 1 as shown particularly in FIG. 2. Each of the second die apertures 5 is provided at its inlet end with a bevelled entry 7 arranged asymmetrically relative to the longitudinal axis of the said second die aperture 5 and extending toward the first die aperture 3. More specifically, a line joining the longitudinal axes of the first die aperture 3 and a second die aperture 5 will bisect the bevelled entry 7 of the said second die aperture 5. The included angle $\alpha$ at the intersection of the bevelled entry 7 and the conical mouth 2 for each of the second die apertures 5, as shown in FIGS. 1 and 3, advantageously will lie in the approximate range of 45°–50°, although the invention is useful with other values of $\alpha$. Each second die aperture 5 communicates with a passageway 8 at the rear end of the die 1.

FIG. 3 shows a preferred method for forming bevelled entries 7 at the inlet ends of second die apertures 5. At the location of each desired second die aperture 5 a cylindrical hole 9 is bored through, as indicated partially in dotted outline. Thereafter, a rotary tapered cutting tool 10, shown in phantom outline in the figure, is advanced into the cylindrical hole 9, with one side of the rotating tapered cutting edge parallel to the outer peripheral edge of the cylindrical hole 9, and with the longitudinal axis of the cutting tool 10 parallel to a line extending between the longitudinal axes of the first die aperture 3 and the cylindrical hole 9 thereby completing the formation of the second die aperture 5.

It has been found that with the specific arrangement hereinabove described, a billet of material 11, coated with die lubricating material such as castor oil, beeswax or polyethylene wax, when advanced into the mouth 2 of die 1 as in a hydrostatic extrusion process, will be evenly distributed among all of the said die apertures 3 and 5, so that each of the said die apertures 3 and 5 will receive billet material at an equal rate, and will produce extruded product such as wire 12 at the same rate as the other die apertures 3 and 5.

Die 1 has been shown with eight second die apertures 5, spaced 45° apart. It will be understood that die 1 may have as few as two such second die apertures 5 or more than eight such second die apertures 5, radially equispaced around a first die aperture 3.

Die 1 may be used to particular advantage in hydrostatic extrusion apparatus of the type disclosed in U.S. Pat. No. 3,740,985 (1973), although it is capable of use in other types of extrusion apparatus. The said hydrostatic extrusion apparatus will be briefly described hereinbelow to aid in understanding the present invention.

U.S. Pat. No. 3,740,985 discloses coating the elongated surface of billet material with a shear transmitting medium which may, for example, be beeswax or polyethylene wax, and exerting through the shear transmitting medium a frictional or viscous drag force along the elongated surface of the billet material thereby to advance the billet material through a die to produce extruded product.

The shear transmitting medium desirably has high viscosity and shear strength, is capable of lubricating the die, provides good wetting action on the billet material, and has minimal viscosity variation with respect to pressure, temperature and shearing rate.

The means which exerts, through the shear transmitting medium, viscous drag force along the elongated surface of the billet material comprises trains of gripping element segments, each train being continuously propelled by pinion gears around a separate endless path, all of the trains of gripping element segments meeting along one length of travel from a first station upstream of a die to a second station downstream of the die and cooperating along said common length of travel to form a continuously moving train of centrally apertured gripping elements moving toward the die. The inner peripheries of the said apertures engaging the outer surface of the coating of shear transmitting medium on the billet material generate shear forces in the said medium which shear forces produce a frictional or viscous drag force along the elongated surface of the billet material to build up axial stress in the billet material and advance the billet material through the die. A pressure cylinder surrounds the centrally apertured gripping elements upstream of the die and exerts a normal pressure gradient on said gripping elements increasing toward the die, whereby a normal stress gradient is built up in the billet material increasing toward the die. These axial and normal stresses stress the billet material far above its yield strength and increase its ductility, or capacity for deformation without fracture.

Specific details of the extrusion apparatus, insofar as they do not relate to multiple extrusion and die design, are not part of the present disclosure. Reference should be made to U.S. Pat. No. 3,740,985 if information on such details is desired.

The use of die 1 is illustrated in FIG. 4.

Die 1 is supported in die stem 13 in the manner disclosed in U.S. Pat. No. 3,740,985, the said die stem 13 having apertures extending therethrough in registry with apertures 4 and 8 of die 1.

Billet 11, coated with shear transmitting medium such as beeswax or polyethylene wax, is advanced to and extruded through die 1 by means of gripping element segments 14 propelled toward and past the die 1 by pinion gears (not shown) engaging teeth 15 on the exterior surfaces of the said gripping element segments 14, in the manner taught in U.S. Pat. No. 3,740,985. The gripping element segments 14 cooperating as a train of gripping elements constitute a pressure chamber surrounding the billet 11 and exert, through the coating of shear transmitting medium, a frictional or viscous drag force along the surface of the billet 11 thereby advancing the said billet 11 against die 1 and through die apertures 3 and 5 therein.

It will be understood that, in the manner taught in U.S. Pat. No. 3,740,985 the gripping elements are surrounded upstream of die 1 by a pressure cylinder (not shown) whereby a normal pressure gradient increasing toward die 1 and indicated diagrammatically by arrows of increasing length in FIG. 4, is applied to the billet 11.

In the foregoing manner, axial and normal stress gradients, increasing toward die 1 to a value above the yield strength of the material of billet 11, are built up in the billet 11 as the said billet is advanced, by frictional or viscous drag force along its surface, toward and into die 1 and through die apertures 3 and 5 to produce simultaneously a plurality of extruded wires 12.

Figure 6:
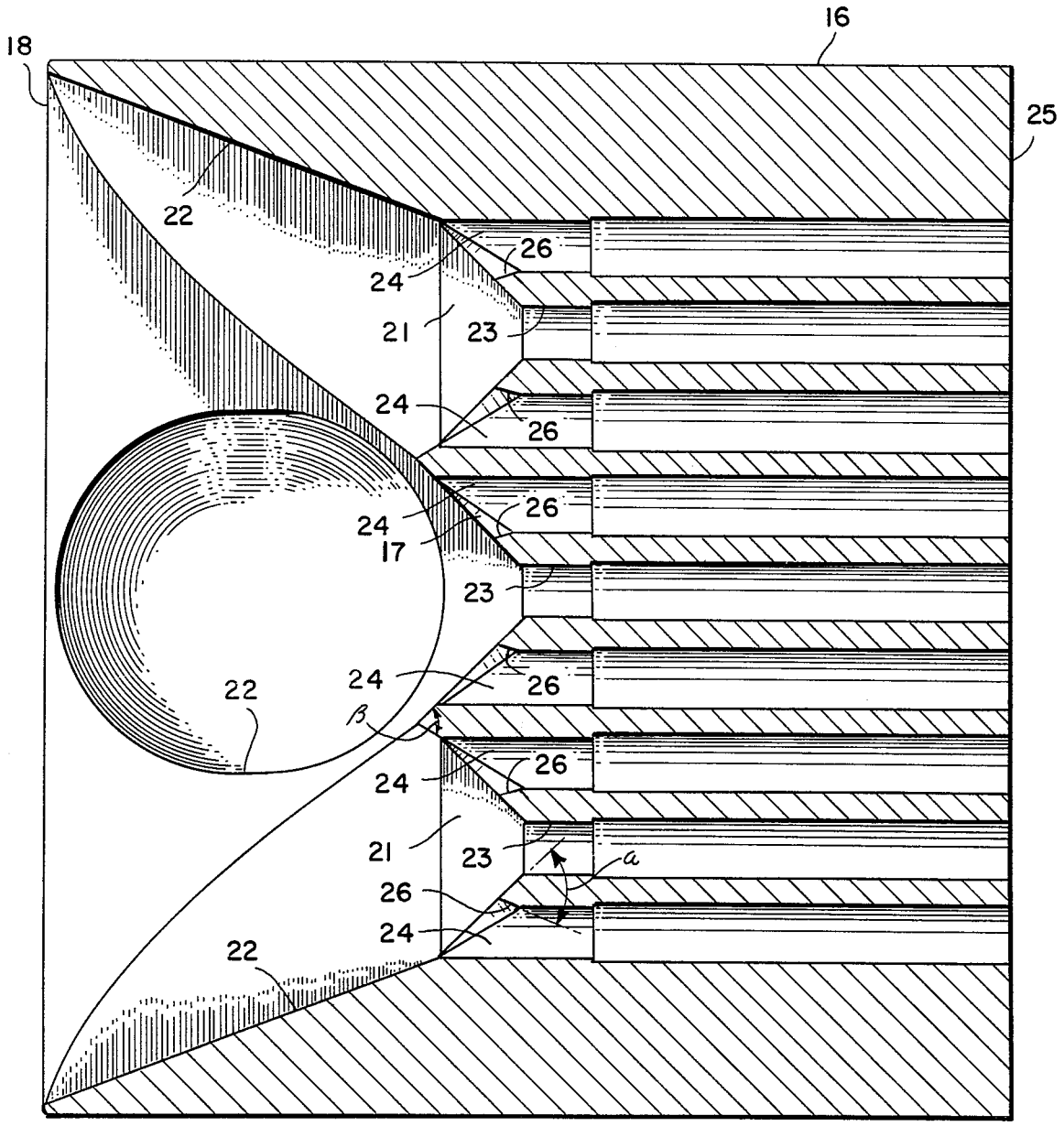
FIG. 6 represents a medial longitudinal section of the die of FIG. 5, taken along the line 6—6 of FIG. 5.

FIGS. 5 and 6 show another embodiment of a multiple extrusion die 16 having a flared mouth 17 extending from the upstream or entrance end 18 of the said die 16 back to a first multiple aperture grouping 19 within die 16 and centered on the longitudinal axis thereof. The first multiple aperture grouping 19 is surrounded by several radially equispaced second multiple aperture groupings 20, each of which latter has a conical mouth 21 at its entrance end communicating with the flared mouth 17 through a conical transitional opening 22.

The first multiple aperture grouping 19 comprises a central die aperture 23 to which the flared mouth 17 serves as a converging entry. Each of the second multiple aperture groupings 20 comprises a central die aperture 23 to which the conical mouth 21 serves as a converging entry. The central die apertures 23 of the first and second multiple aperture groupings 19 and 20, respectively, are surrounded by several radially equispaced peripheral die apertures 24, the said die apertures 23 and 24 extending through the body of the die 16 to the downstream or exit end 25 thereof. Each peripheral die aperture 24 has a bevelled entry 26 extending around that half of said die aperture 24 adjacent its respective central die aperture 23. As seen particularly in FIG. 5, bevelled entries 26 are maximum dimension on the lines joining the centers of die apertures 23 and 24. The central die apertures 23 are located on the longitudinal axis of the die 16, for the first multiple aperture grouping 19, and on the longitudinal axes of the conical mouths 21, for the second multiple aperture groupings 20. The entrances to all of the central die apertures 23 lie substantially on the same transverse plane through the die 16. The angles $\alpha$ and $\beta$, as shown in FIG. 6, advantageously will be within the approximate range of 45°–50°, although the invention is useful with other values of $\alpha$ and $\beta$.

Advantageously, die 16 may be employed in apparatus of the type shown in U.S. Pat. No. 3,740,985 in the same manner as die 1 shown in FIG. 4.

The particular configuration of die 16 results in an even distribution of billet material among all the first and second multiple aperture groupings 19 and 20, and among all of the die apertures 23 and 24 in each of the first and second multiple aperture groupings 19 and 20. This even distribution of billet material to all the multiple aperture groupings 19 and 20 and to all of the die apertures 23 and 24 in said multiple aperture groupings 19 and 20, provides for simultaneous extrusion at substantially equal velocities of multiple wires 12 of uniform quality.

Dies 1 and 16 hereinabove disclosed have been described in association with extrusion apparatus of the type shown in U.S. Pat. No. 3,740,985. It should be understood that these dies are capable of use in other types of apparatus whereby billet material coated with an appropriate lubricant may be operated upon to produce simultaneously plural products.

What is claimed is:

1. A die comprising:

a. a die body having an entrance end;

b. a plurality of die apertures extending through said die body;

c. said die apertures being arranged in the form of groups, each group comprising a plurality of die apertures;

d. a plurality of flared mouths, each flared mouth being associated with one of said groups and opening toward the entrance end of said die body;

e. in each group of die apertures one of said die apertures is centered on the longitudinal axis of the flared mouth associated with said group.

2. A die comprising:

a. a die body having an entrance end;

b. a plurality of die apertures extending through said die body;

c. said die apertures being arranged in the form of groups, each group comprising a plurality of die apertures;

d. a plurality of flared mouths, each flared mouth being associated with one of said groups and opening toward the entrance end of said die body;

e. one of said groups is centered on the longitudinal axis of said die body, the others of said groups being radially spaced around the said centrally positioned groups.

3. A die as in claim 2, wherein:

f. in each group of die apertures, one of said die apertures is centered on the longitudinal axis of the flared mouth associated with said group.

4. A die comprising:

a. a die body having an inlet end and an outlet end;

b. a first group of a plurality of die apertures extending through said die body, said group having an entrance end and an exit end and centered on the longitudinal axis of said die body;

c. a first conical mouth extending from the inlet end of said die body to the entrance end of said first group, said first conical mouth opening from the entrance end of said first group toward the inlet end of said die body;

d. a plurality of second groups of die apertures, each of said second groups comprising a plurality of die apertures and having an entrance end and an exit end, said second groups of die apertures being radially spaced around said first group of die apertures;

e. a plurality of second conical mouths, each second conical mouth being associated with one of said second groups of die apertures, each second mouth extending from the entrance end of its respective second group and intersecting the first conical mouth, said second conical mouths opening forwardly from the entrance end of its respective second group.

5. A die as in claim 4, wherein:

f. in said first group of die apertures, one of said die apertures is centered on the longitudinal axis of the die body, and the other die apertures of said first group are radially spaced around said centered die aperture.

6. A die as in claim 4, wherein:

f. in each of said second groups of die apertures, one of said die apertures is centered on the longitudinal axis of the second conical mouth associated with said second group, and the other die apertures of said second groups are radially spaced around said centered die aperture.

7. A die as in claim 6, wherein:

g. in said first grouping of die apertures, one of said die apertures is centered on the longitudinal axis of the die body, and the other die apertures of said first group are radially spaced around said centered die aperture.

* * * * *